US009539450B2

(12) United States Patent
Rouse et al.

(10) Patent No.: US 9,539,450 B2
(45) Date of Patent: Jan. 10, 2017

(54) FIRE EXTINGUISHING SYSTEM AND DIAGNOSTIC METHODS

(71) Applicant: GUARDIAN SAFETY SOLUTIONS INTERNATIONAL, INC., Dallas, TX (US)

(72) Inventors: J. Paul Rouse, Forney, TX (US); Richard Bolack, Garland, TX (US); Charles P. Schaefer, Garland, TX (US)

(73) Assignee: GUARDIAN SAFETY SOLUTIONS INTERNATIONAL, INC., Dallas, TX (US)

( * ) Notice: Subject to any disclaimer, the term of this patent is extended or adjusted under 35 U.S.C. 154(b) by 475 days.

(21) Appl. No.: 13/927,440

(22) Filed: Jun. 26, 2013

(65) Prior Publication Data

US 2013/0341053 A1 Dec. 26, 2013

Related U.S. Application Data

(60) Provisional application No. 61/664,334, filed on Jun. 26, 2012.

(51) Int. Cl.

| | |
|---|---|
| ***A62C 3/00*** | (2006.01) |
| ***A62C 37/44*** | (2006.01) |
| ***A62C 37/50*** | (2006.01) |
| ***A62C 35/60*** | (2006.01) |

(52) U.S. Cl.

CPC ..... *A62C 35/605* (2013.01); *A62C 37/50* (2013.01); *A62C 3/006* (2013.01)

(58) Field of Classification Search

CPC ..... A62C 3/006; A62C 3/16; A62C 35/13; A62C 35/605; A62C 37/40; A62C 37/50

See application file for complete search history.

(56) References Cited

U.S. PATENT DOCUMENTS

| | | | | |
|---|---|---|---|---|
| 4,356,870 | A * | 11/1982 | Gaylord | A62C 35/58 126/299 R |
| 5,177,461 | A | 1/1993 | Budzyna et al. | |
| 5,207,276 | A | 5/1993 | Scofield | |
| 5,351,760 | A | 10/1994 | Tabor. Jr. | |
| 5,508,568 | A | 4/1996 | Mammen | |
| 5,697,450 | A | 12/1997 | Stehling et al. | |
| 5,871,057 | A | 2/1999 | Stehling et al. | |
| 6,029,751 | A * | 2/2000 | Ford | A62C 35/023 169/60 |
| 6,044,913 | A | 4/2000 | Stehling et al. | |
| 9,030,319 | B1 * | 5/2015 | Haynes | G08B 17/00 340/539.22 |
| 2009/0294141 | A1 | 12/2009 | Rouse et al. | |

OTHER PUBLICATIONS

Examination Search Report dated Oct. 25, 2015 issued in corresponding CA 2819414 application (p. 1).

* cited by examiner

*Primary Examiner* — Darren W Gorman

(74) *Attorney, Agent, or Firm* — Millen, White, Zelano & Branigan, P.C.; William Nixon

(57) ABSTRACT

A fire extinguishing system prevents fires or other emergency conditions on a heating device, such as a stove. The system uses sensors to detect the emergency and alert an operator. The system dumps fire suppressant material onto the heating device. The system also may shut-off power to the heating device. An alarm circuit and associated functionality assures the system is in working order by using diagnostic tests and other checks.

15 Claims, 12 Drawing Sheets

FIRE EXTINGUISHING SYSTEM AND DIAGNOSTIC METHODS

FIELD OF THE INVENTION

The present invention relates to an automatically operated fire extinguishing system and diagnostic methods. More particularly, the present invention relates to fire extinguishing systems and diagnostic methods especially useful for the extinguishing of fires on heating devices and the cutting of power to such devices.

DESCRIPTION OF THE RELATED ART

Systems exist for extinguishing fires that occur on residential cook stoves, fires and ranges. These systems rely on an array of heat sensing elements coupled to one another with cables strung around the internal periphery of range hoods. Upon detection of a fire or other emergency, these systems initiate a fire prevention mechanism to extinguish the fire and prevent any further damage.

Improper installation, however, of these fire prevention systems may result in faulty equipment, battery degradation, and false alarms. As one uses the stove, food stuff in grease, for example, may accumulate on the wiring and sensors. A shut-off device for the stove may not operate under these conditions. When a fire occurs, the fire extinguishing system may not detect it and may not shut off the cooking device to prevent further damage or harm. This may be especially true in a commercial setting. Moreover, the systems do not account for loss of functionality over time.

SUMMARY OF THE INVENTION

Embodiments of the present invention are directed to a system for detecting and suppressing fires on cook stoves and heating devices being energized by a source of gas or electric current. Further, embodiments of the present invention are directed to a configuration to shut off power or gas during a fire. The system includes at least one heat sensor circuit comprised of one or more heat sensors that are connected to an alarm, or a control, circuit. When the heat sensors detect an increased temperature that indicates a fire, the control circuit sends a radio frequency signal to shut off power or gas and to activate any fire extinguishing processes. Embodiments of the present invention also include a diagnostic protocol to identify and alert an operator of faulty conditions within the system.

According to additional embodiments, a radio frequency cut off assembly, triggered by an RF signal initiated by the alarm circuit, is placed between the burners and the source of gas or electric current and interrupts the flow of gas or electric current from the source to the burners. Other shut-off configurations also may be used. A fire extinguishing system installed within the disclosed system includes outlet nozzles for directing the fire extinguishing material towards the burners of the cook stove or heating device.

Extensive diagnostic tests and processes are included to aid in installation and troubleshooting for possible faulty conditions. The fire extinguishing system also includes the external RF circuit, or link, to drive remote shut-off. The fire extinguishing system includes a sensing circuit and process to detect a low pressure condition to activate the shut-off sequence. Further, a low battery voltage may be determined even when the optional AC power is supplied. If a low battery condition persists for an extended period of time, then the fire extinguishing system may initiate the shut-off sequence to prevent range operation when the battery voltage is too low for full functionality. Auxiliary output may be provided when the shut-off sequence is initiated to indicate trouble for remote monitoring. Auxiliary output also is provided to indicate a full alarm condition with suppressant dump. This function may be used for remote monitoring or a building evacuation alarm.

According to the present invention, a fire extinguishing system for an appliance to detect an emergency condition is disclosed. The fire extinguishing system includes at least one sensor for detecting a condition regarding the appliance. The fire extinguishing system also includes an alarm circuit coupled to the at least one sensor. The fire extinguishing system also includes a radio frequency (RF) transmitter coupled to the alarm circuit to send an RF signal. The fire extinguishing system also includes a shut-off assembly configured to shut-off the appliance. The shut-off assembly includes an RF receiver configured to receive the RF signal.

Further according to the present invention, a safety device for an appliance is disclosed. The safety device includes an RF receiver to receive an RF signal transmitted in response to a command from an alarm circuit. The safety device also includes a shut-off assembly coupled between the appliance and a source. A connection is closed between the appliance and the source in response to the RF signal.

Further according to the present invention, a method for detecting an emergency condition or a faulty condition within a fire extinguishing system for an appliance is disclosed. The method includes entering an alarm sequence mode during detection of the emergency condition. The method also includes entering a mode to detect the faulty condition upon detection of a condition by an alarm circuit.

Further according to the present invention, a method for shutting off an appliance during an emergency condition is disclosed. The method includes detecting a condition on the appliance using an alarm circuit. The method also includes sending an RF signal from a transmitter connected to the alarm circuit in response to the detected condition. The method also includes receiving the RF signal at a receiver. The method also includes activating a shut-off sequence in response to the RF signal to shut off power or gas to the appliance.

BRIEF DESCRIPTION OF THE DRAWINGS

Various other features and attendant advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

Figure 1:
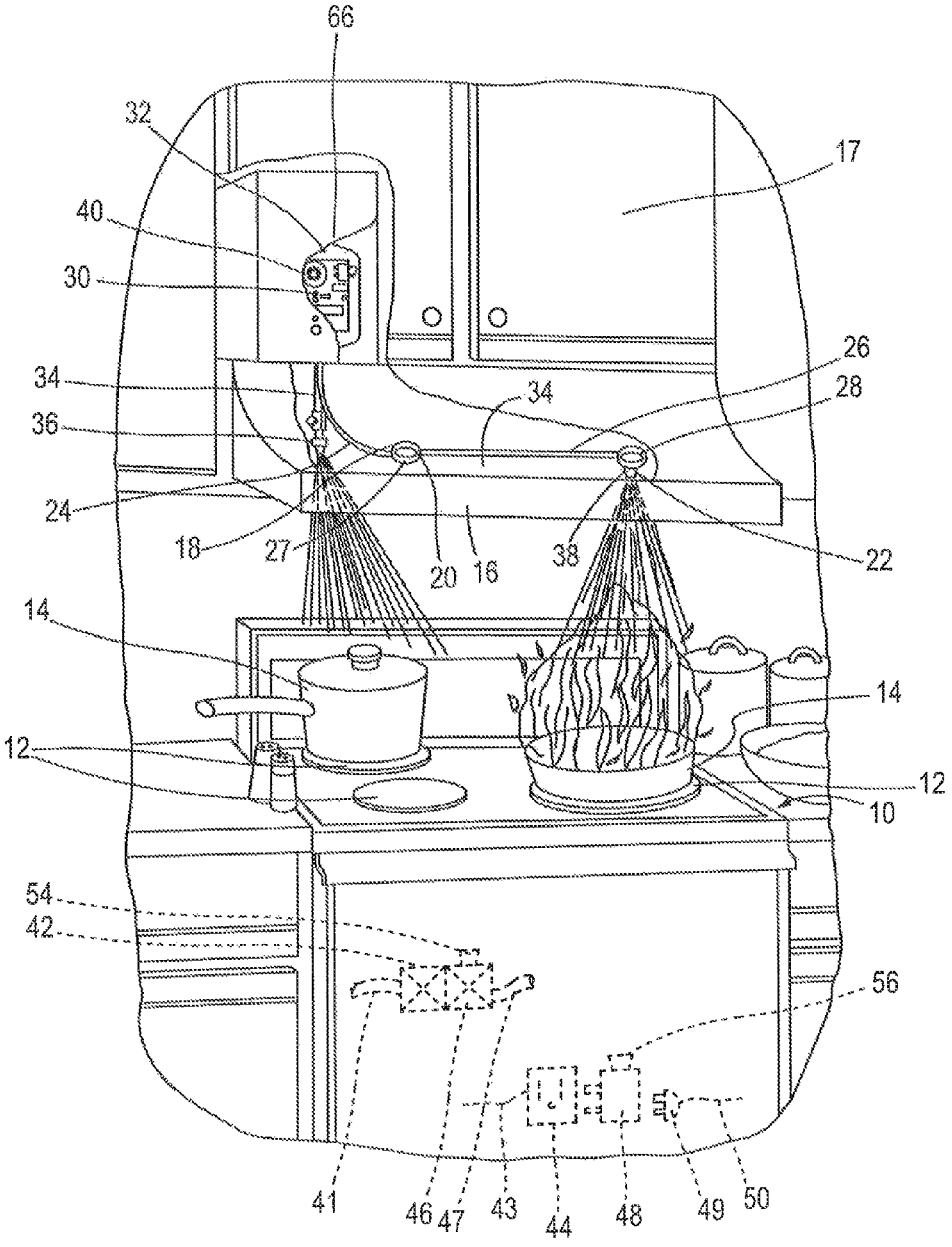
FIG. 1 illustrates a heating device for cooking operations having a fire extinguishing system according to the disclosed embodiments.

FIG. 1 depicts a residential heating device 10 for cooking operations with a fire extinguishing system according to the disclosed embodiments. Alternatively, heating device 10 may be a commercial stove or fryer. As shown, heating device 10 includes four burners 12 thereon for cooking food in pans or pots 14. A range hood 16 is disposed above heating device 10 and attached to a cabinet 17.

Heat sensor sub-assemblies 20 and 22 are mounted within hood 16. Heat sensor sub-assemblies 20 and 22 are connected by leads 24 and 26 to an electrical alarm, or control, circuit 30 disposed within cabinet 17. The number of heat sensors 27 and 28 may vary depending upon a specific application or configuration of the disclosed fire extinguishing system. Electronic control circuit 30 is housed either with or approximate a canister of fire extinguisher material that is connected by a tubular line 34 to first and second dispensing nozzles 36 and 38.

When a pan 14 containing food or other material is left on a burner 12 of heating device 10 while receiving heat, moisture may evaporate from the pan and the grease or other food such that the food or materials left within pan 14 ignites under certain conditions. If this occurs, the electrical properties of heat sensors 27 and 28 change due to the elevated temperature caused by the fire. Heat sensors 27 and 28 are connected over lines 24 and 26 to control circuit 30 thereby allowing alarm circuit 30 to sense the elevated temperature caused by the fire. Bypass circuit 18 may connect line 26 to line 24 in the event heat sensor sub-assembly 20 is not working. Alarm circuit 30 then transmits a signal that opens the valve of fire extinguisher 32 to cause fire extinguisher material or fluid to discharge through tubular line 34 to first and second nozzles 36 and 38.

Heat sensor sub-assemblies 20 and 22 may include heat sensors 27 and 28 being thermistors, or resistive devices that have a resistance proportional to temperature, diodes, conductive devices that have a forward voltage proportional to temperature, or an active temperature sensor, a sensor or sensor circuit that has a voltage, current or a resistance output responsive to temperature. Preferably, heat sensors 27 and 28 are diodes.

Upon the occurrence of a fire, electrical control circuit 30 may activate an audible alarm 40, which emits a high decibel signal to alert occupants of the fire. Other actions also may be taken, as disclosed below. For example, a shut-off sequence may be initiated.

Electronic alarm circuit 30 also may include an auxiliary relay providing the capability for activating remote devices such as emergency power shut-offs, emergency lighting, security systems, automatic telephone dialers, or wide area alarm systems. These remote devices may be wired directly to the relay, or the relay may activate an auxiliary circuit to transmit low level radio frequency, ultra sonic sound, and infra-red or laser to be used as a trigger. Additionally, these remote devices may be triggered by detecting an RF signal.

As shown in FIG. 1, if heating device 10 is a gas stove, then behind the cook-top range is a gas line 41 with a conventional, manually operated gas valve 42 for providing heat to the range with cooking gas. A supplemental gas shut-off valve assembly 46 is attached to a gas line 47 supplying heating device 10. Gas shut-off valve assembly 46 may be activated by a signal activated electronic circuit 54 capable of detecting an RF signal of a transmitter. This configuration is disclosed in greater detail below. The circuitry of alarm circuit 30 may be battery powered by a battery.

If heating device 10 is an electric stove, then behind the cook-top range includes an electric house current AC line cord 50 with a plug 49 allowing connection to a conventional electric wall outlet 44 connected to power line 43. A supplemental electric shut-off contactor assembly 48 may be installed between stove plug 49 and wall receptacle 44. Assembly 48 may be activated by a signal activated electronic circuit 56 capable of detecting a signal sent by a transmitter within alarm circuit 30. In this embodiment, the alarm circuitry may be powered by an AC line.

Figure 2:
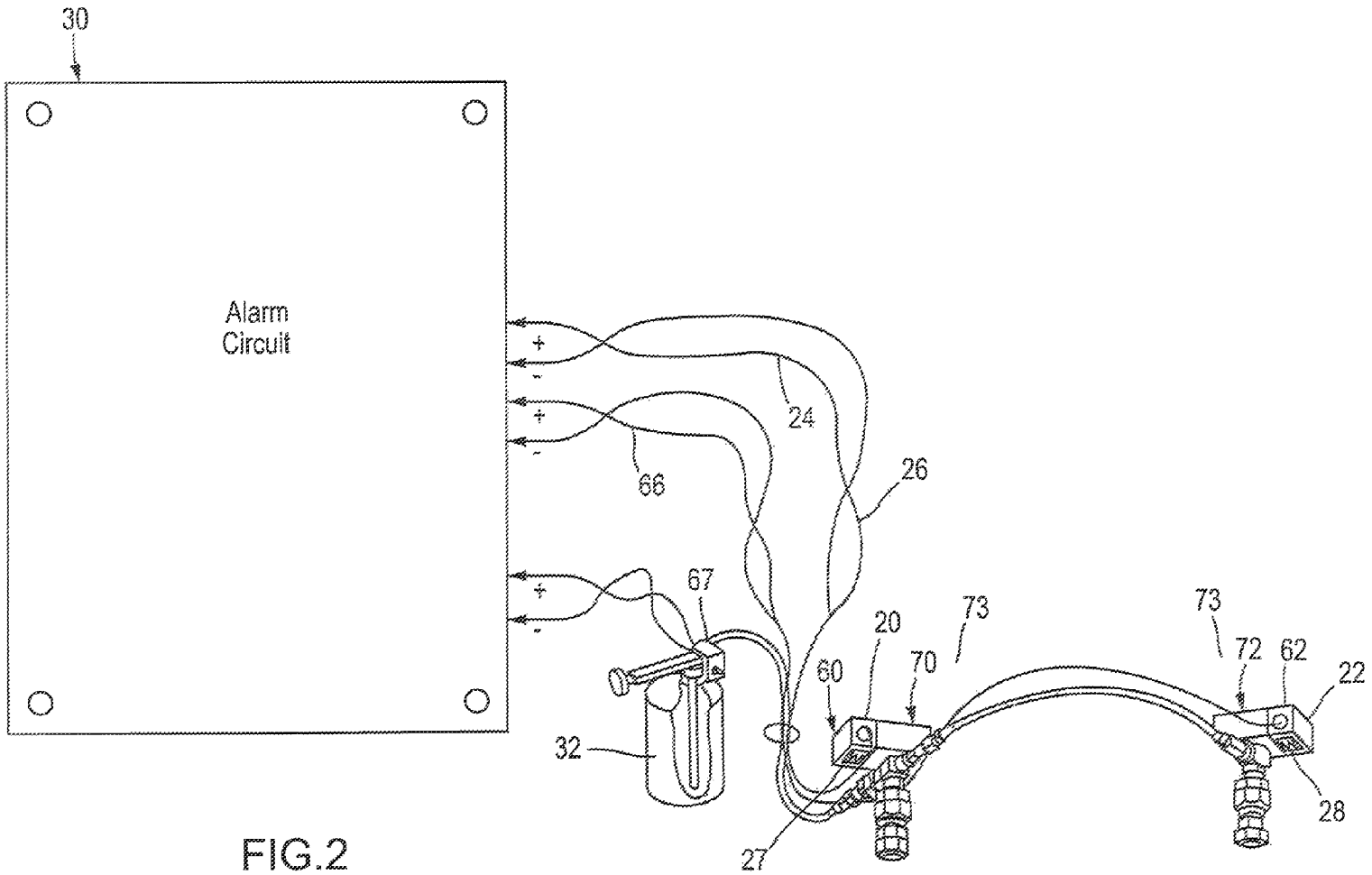
FIG. 2 illustrates various components of the disclosed fire extinguishing system in further detail.

FIG. 2 depicts various components of the disclosed fire extinguishing system in further detail. Extinguisher discharge nozzle assembly 70 and 72 may be attached to the underside of a range hood with permanent magnet 73. This configuration allows for ease of installation and allows the proper positioning of the nozzle assembly for specific applications. For example, nozzle assembly 70 and 72 may be positioned above large burners on heating device 10.

Heat sensor sub-assemblies 20 and 22 are mounted in a metal housing 60 and 62. Each of the metal heat sensor housing 60 and 62 are positioned against the side of a nozzle assembly 70 and 72, respectively. Sensor housing 60 and 62 may be held in place by magnetic force applied from one of the magnets 73. Heat sensors 20 and 22 are electrically connected to control circuit 30 by wiring 24. Alarm circuit 30 is connected by electrical wiring 66 to a solenoid valve 67 which, when activated, opens to release fire suppressant from fire extinguisher canister 32. Alarm 40 may emit an audio signal to draw attention to the hazardous condition causing the alarm, and, if the preferable acoustic activated cut-off device is used, audio alarm 40 causes a cut-off of gas or electricity to heating device 10. Moreover, alarm circuit 30 may activate an RF transmitter, disclosed below, to shut off power or gas.

Figure 3A:
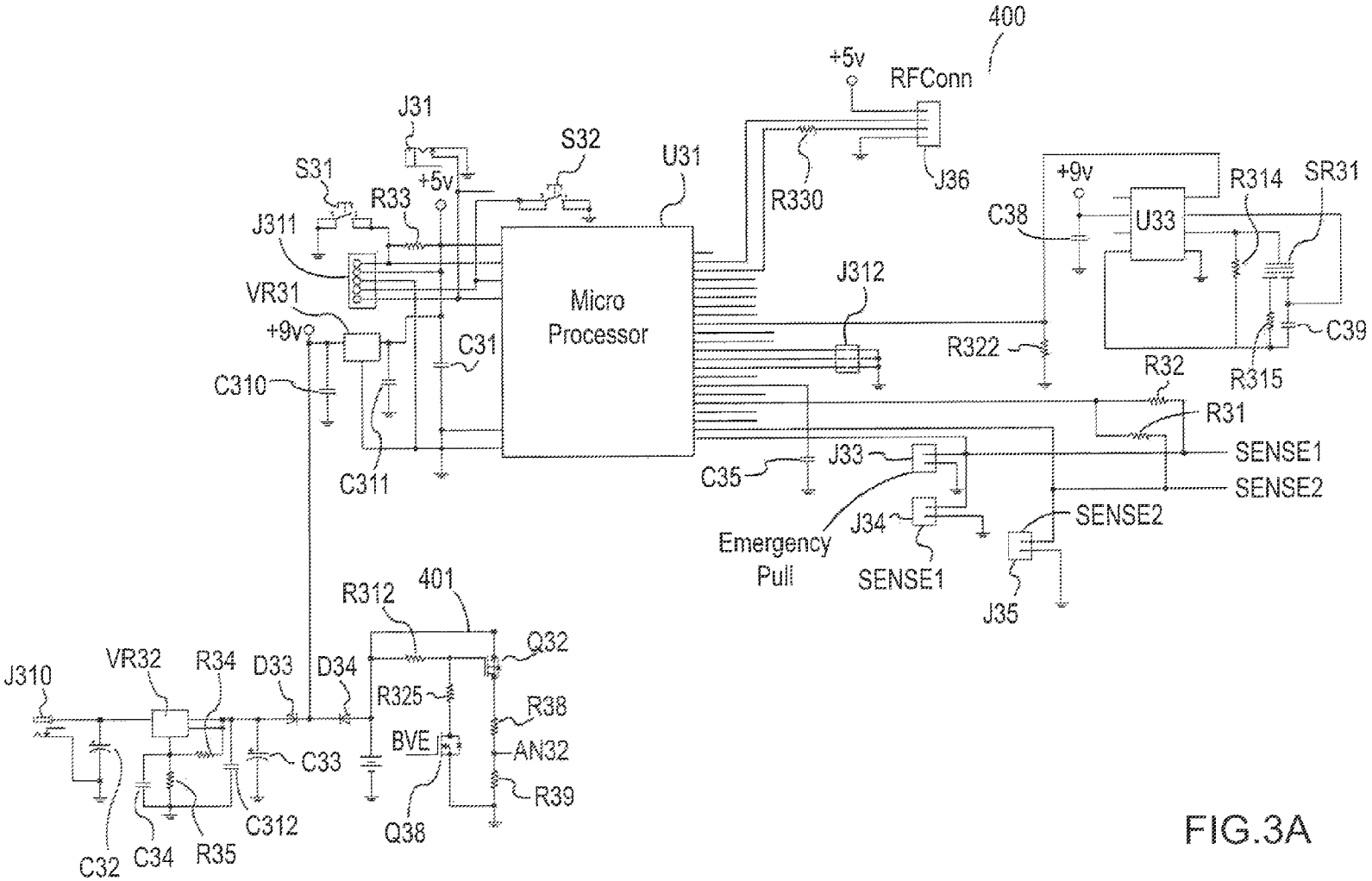
FIG. 3A illustrates an alarm control circuit of the fire extinguishing system according to the disclosed embodiments.
Figure 3B:
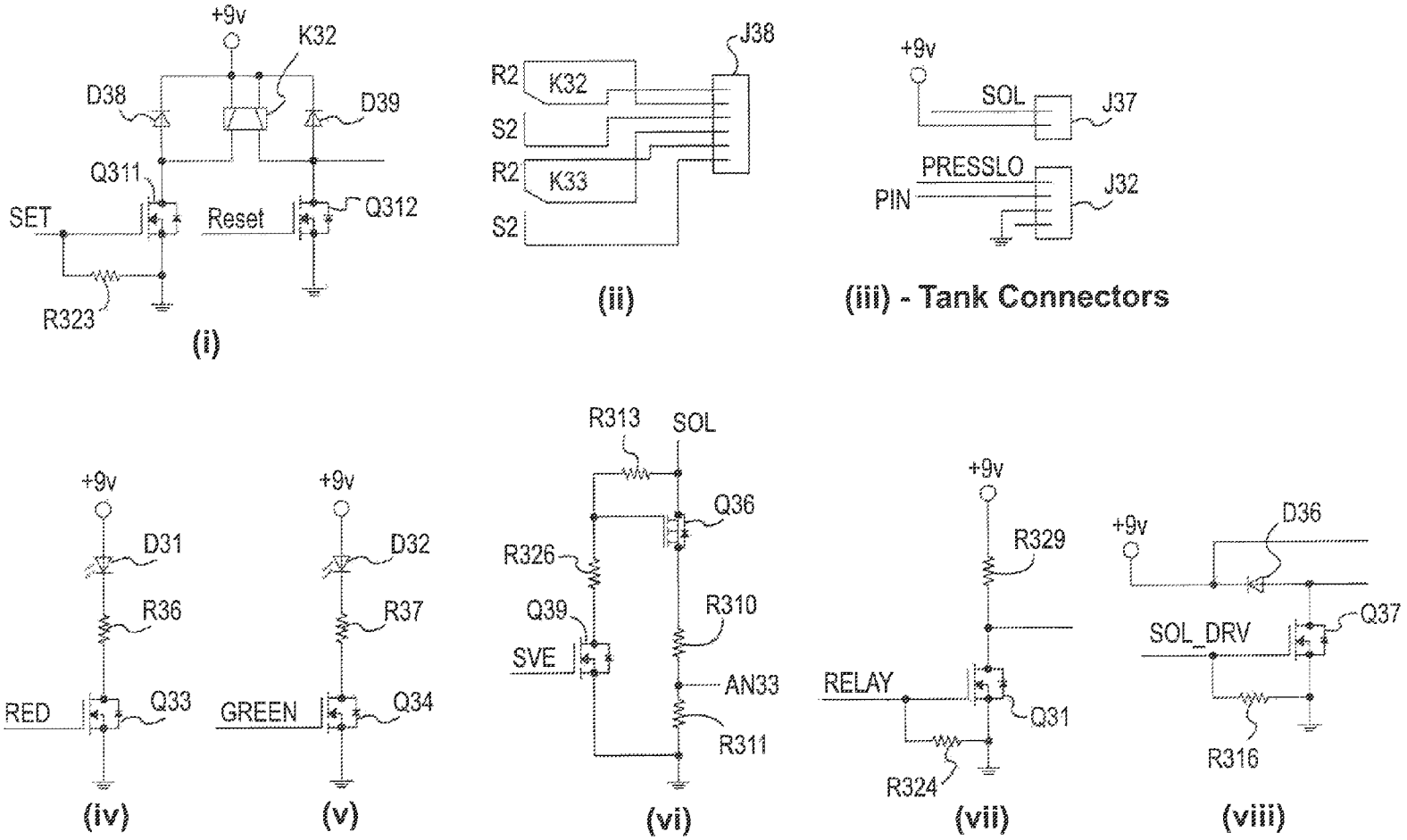
FIG. 3B further illustrates components of the alarm control circuit of the fire extinguishing system according to the disclosed embodiments.
Figure 3C:
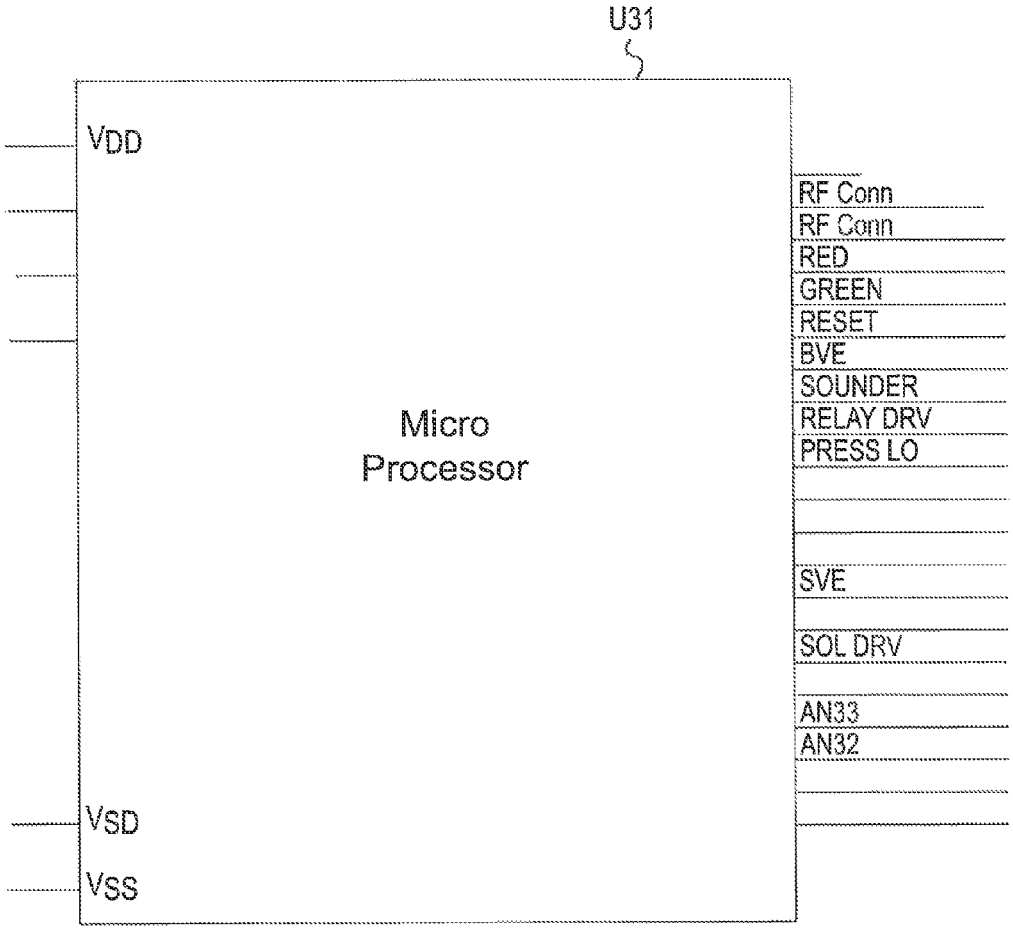
FIG. 3C illustrates a block diagram of a microprocessor used in the alarm control circuit.

FIGS. 3A-C depicts alarm control circuit 30 of the fire extinguishing system according to the disclosed embodiments. Alarm circuit 30 is powered by 9-volts DC. This power is supplied through a 9-volt battery, as shown by battery circuit 401 in FIG. 3A. Power also may be supplied from the AC adapter. Even when power is supplied by the AC adapter, the battery must be present, or an error condition will result. If the battery is depleted or not present when AC power is applied, control circuit 30 will not enter its normal run mode and may issue a "beep" code as well as display a flashing red LED to indicate that something is wrong. If the battery voltage becomes depleted to approximately 7.5 volts while the circuit is operational, alarm circuit 30 will continue to work, but a short beep will issue about every 2 minutes to indicate that the battery needs to be replaced. When AC power is provided, it enters the circuit board for control circuit 30 through connector J310. The AC power is regulated to approximately 9-volts by regulator VR32, shown in FIG. 3A, and its associated parts. The two possible sources of supply are diode "ored" by diodes D33 and D44 to supply the various circuits on the board.

Regulator caps VR31 regulates the 9-volt supply down to 5-volts to power microprocessor U31. Other circuits and components on the board may use the 9-volts applied directly, as shown. Microprocessor U31 tests various sections of the circuit during the power up phase, during diagnostic tests, and periodically during the normal run phase. To minimize power consumption, sensing circuits are disabled when not in use. Transistors Q38 and Q32 are turned on by signal BVE and switch battery voltage through to resistor divider R38 and R39 to AN32 which can then be read by microprocessor U31. Transistors Q39 and Q36 are turned on by signal SVE and switch solenoid voltage through to resistor divider R310 and R311 to AN33 which can then be read by microprocessor U31.

If the solenoid is properly connected, the 9-volt power supplied to the solenoid should be seen on the solenoid activation signal SOL. The external sensing circuits sense 1 and sense 2 for over temperature are connected to the board by J34 and J35. These sensors may correspond to sensors 20 and 22 in FIGS. 1 and 2. Current is supplied to these circuits when microprocessor U31 supplies a positive voltage to resistor R31 and resistor R32. Microprocessor U31 also reads the sensors of voltage on appropriate pins. Power is removed from the sense circuits. This removal occurs for a short time, and during run mode, so that this reading is performed about every 2 seconds.

A red LED, identified as diode D31, and a green LED, identified by diode D32, are provided to inform installation and maintenance personnel of the status of the circuit board for alarm circuit 30. As noted, various conditions call for the red or green LED to be activated. Microprocessor U31 activates these by turning on transistor Q33 or transistor Q34, respectively. The red LED may be confused as shown in FIG. 3B (iv). The green LED may be configured as shown in FIG. 3B (v).

An audible alert is delivered by piezo sounder SR31 and integrated circuit U33. Microprocessor U31 activates sounder SR31 via a pin connected to the sounder circuit. A pull-down resistor R322 is provided to disable sounder SR31 during power-shut or resetting of microprocessor U31. Capacitors C38 and C39, and resistors R314 and R315 also are configured in this circuit as shown in FIG. 3A.

The disclosed circuit also includes two duel-coil latching relays K32 and K33. Relay K32 is a building alarm relay and is activated in the event of a full alarm condition, such as a fire being detected. It is activated by a pulse from the microprocessor U31 on driver transistor Q311. Contacts of relay K32 are available for off-board use via connector J38. Relay K33 is a latching shut-off relay used to remove power from the range. It is activated either by microprocessor U31 pulsing the signal SOL_DRV or by sudden loss of battery voltage. Contacts from relays K32 and K33 are available for off-board use via connector J38. A separate set of contacts from relay K33 are available at connector J39. Relays K32 and K33 are reset by a pulse from microprocessor U31 through driver transistor Q312 during reset by the RESET signal. Relays K32 and K33 may be configured as shown in FIG. 3B (i) and (ii).

During a full alarm condition, microprocessor U31 will cause a suppressant dump of extinguishing material from fire extinguisher canister 32. The dump is activated by turning on transistor Q37 to drive the solenoid output using the SOL_DRV signal. Solenoid drive and the 9-volt source for the solenoid are provided at connector J37. A pull-down resistor R316 is provided at transistor Q37 to prevent inadvertent activation of the solenoid during power-up or reset. Diode D36 is a switching diode configured as shown in FIG. 3B (viii).

Referring to FIG. 3A, switch S31 is used for a reset function and switch S32 for a test function. Jack J31 is used to detect the presence of a pull-pin. Jack J31 is normally closed to give ground on the corresponding microprocessor pin if the pull-pin is not present. The pin must be inserted in J31 for normal operation of the fire extinguishing system.

Connector J311 is used for programming of microprocessor U3. Connector J33 may be used for an emergency pull input. A short across J311 will cause a short across sensor 1 and result in a full alarm and suppressed dump. Connector J32 may be used for further expansion or configuration options. Connector J36 is provided for optional use of a transmitter, disclosed in greater detail below to provide an RF link for the shut-off function. Pins of microprocessor U31 provide power and ground, while another pin provides a low logic through resistor R33 to enable transmitter. Not all pins are currently not used.

The connectors of alarm circuit 30 may include a "plug" functionality so that a connector from the various components of the fire extinguishing system plug directly into the circuit. The connectors include pins to receive and transmit signals to the various components from alarm circuit 30. Additional connectors may be included on alarm circuit 30, as needed.

The following connector designations are for illustrative purposes only. Connector J31 may connect to the RCA receptacle for the pull-pin. Connector J32 may connect to the gauge to determine low pressure which may prevent suppressant dump. A pin of connector J32 receives a pressure low indication while another pin is connected to ground. Connector J33 connects to the emergency pull with a pin connected to ground and a pin providing the sense to the pull.

Connector J34 connects to sensor S31 with a pin connected to ground and a pin being the sense lead. Connector J35 connects to sensor 2 with the same pin designations.

Connector J36 connects to the RF transmitter, disclosed in greater detail below. A pin may connect to a +5 volt signal while a pin provides ENABLE and a pin connects to ground. Connector J37 connects to the solenoid circuit. Connector J38 connects to the building alarm. Connector J39 connects to the K33 Relay out for the shut-off sequence.

Connector J310 connects to the optional AC adapter. Connector J311 connects to the programming header. Connector J312 may be reserved for future use.

FIG. 3C depicts the pin connections for microprocessor U31 to the different circuit parts and connectors of alarm circuit 30. The pin connections are illustrative only, and other pin connections may be used. Signals from microprocessor U31 are also shown, and are for illustrative purposes only.

Table 1 includes a list of the components of the circuit schematic shown in FIGS. 3A-C, some of which are disclosed above. The components listed in Table 1 are shown for illustrative purposes only, and the disclosed embodiments are not limited to the values or number of components disclosed therein.

TABLE 1

| | |
|---|---|
| D33, D34, D36, D38-313 | Switching Diodes |
| K32, K33 | Latching Relays |
| J33, J34, J35, J37 | 2-pin connectors |
| J32, J36, J39 | 4-pin connectors |
| J38 | 6-pin connector |
| J311 | 5-pin header |
| J310 | AC power connector |
| S31, S32 | Pushbutton switches |
| C39 | .001 uf capacitor |
| C31, C34, C35, C37, C312 | .1 uf capacitors |
| R314 | 1.5 MOhm resistor |
| C38, C310, C311 | 1 uf capacitors |
| R321 | 3.3 MOhm resistor |
| R36, R37 | 6.8 KOhm resistors |
| XBT1 | Battery holder for 9 volt battery |
| R33, R39, R311, R317, R329, R330 | 10 KOhm resistors |
| C32 | 10 uf/25 volt capacitor |
| C33 | 68 uf/16 volt capacitor |
| R38, R310 | 15 KOhm resistors |
| R31, R32 | 22 KOhm resistors |
| R318, R319, R320 | 47 KOhm resistors |
| R325, R326, R327 | 100 KOhm resistors |
| R34 | 118 Ohm resistor |
| R315, R316, R322-R324 | 150 KOhm resistors |
| R312, R313, R328 | 220 KOhm resistors |
| C36 | 330 uf/16 volt capacitor |
| R35 | 768 Ohm resistor |
| U32 | Triple 3-input NAND CMOS IC |
| D31 | Red LED |
| D32 | Green LED |
| VR31 | 5 volt voltage regulator |
| SR31 | Piezo sounder |
| Q32, Q36 | P-channel FET transistor |
| U31 | Microprocessor |
| Q31, Q33, Q34, Q37, Q38, Q39, Q311, Q312, Q313 | N-channel FET transistors |
| J31 | RCA jack |
| U33 | Horn driver integrated circuit |
| VR32 | Adjustable voltage regulator |

Figure 4:
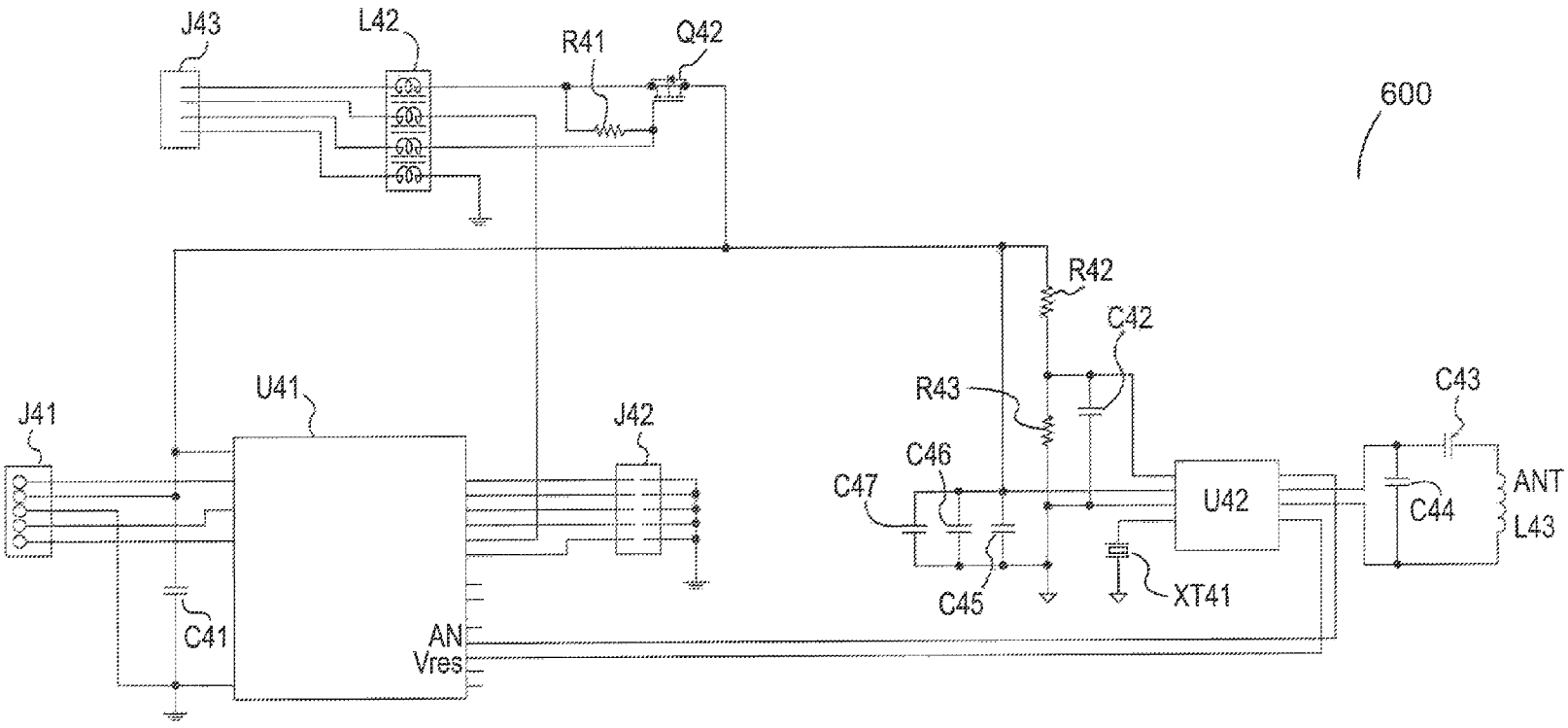
FIG. 4 illustrates a transmitter circuit for the shut-off circuit of the fire extinguishing system according to the disclosed embodiments.

The disclosed embodiments include an RF transmitter and receiver configuration that forms a wireless link for performing a remote shut-off of range power when used with control circuit 30 disclosed above. Other shut-off configurations also may be used. FIG. 4 depicts transmitter circuit 600 for the shut-off circuit of the fire extinguishing system according to the disclosed embodiments. Transmitter circuit 600 may be connected to control circuit 30 via connector J36 of FIG. 3A with connector J43. Preferably, transmitter circuit 600 transmits at a power level of 10 mWatts or less at 433.92 MHz, an unlicensed ISM frequency.

Connections to transmitter circuit 600 pass through a common-mode choke L42 to prevent spurious radiation on the wiring. The entire active circuitry of transmitter circuit 600 is normally in a power-down state due to the P-channel FET transistor Q42 being off. This condition results in a quiescent current close to zero. During transmission, a low level signal is applied to the gate of transistor Q42, powering up transmitter microcontroller U41 and transmitter logic U42. Transmitter circuit 600 will then transmit the same code sequence repeatedly until powered down.

A jumper field at connection J42 allows the code to be modified for installation when there are multiple units in the same general area. A matching configuration of jumpers may be fixed on the receiver board for the transmitter-receiver pair to function together. Preferably, this configuration allows for 32 different codes to be programmed. Thus, a transmitter circuit 600 may not shut off the power of a different heating device within the local vicinity.

When activated, ANT using L43, C43 and C44 will transmit an RF signal to reception and to initiate the shut off sequence. The RF signal may operate on a frequency according to the code programmed into microprocessor U41.

Table 2 includes a list of the components configured to enable the circuit schematic shown in FIG. 4, some of which are disclosed above. The components listed in Table 2 are shown for illustrative purposes only, and the disclosed embodiments are not limited to the values or number of components disclosed therein.

TABLE 2

| | |
|---|---|
| J42 | MAO5-02 connector |
| U42 | RF Transmitter IC |
| J41 | Pin connector |
| C41, C42, C46 | .1 uf/50 volt capacitors |
| C47 | 2.2 uf/10 volt capacitor |
| R43 | 6.8 KOhm resistor |
| C43 | 4.7 pf/50 volt capacitor |
| XT41 | 13.560 MHz crystal |
| C44 | 2.7 pf/50 volt capacitor |
| R41, R42 | 100 KOhm resistors |
| C45 | 100 pf/50 volt capacitor |
| J43 | 4-pin connector |
| Q42 | Transistor |
| U41 | Microprocessor |

Figure 5:
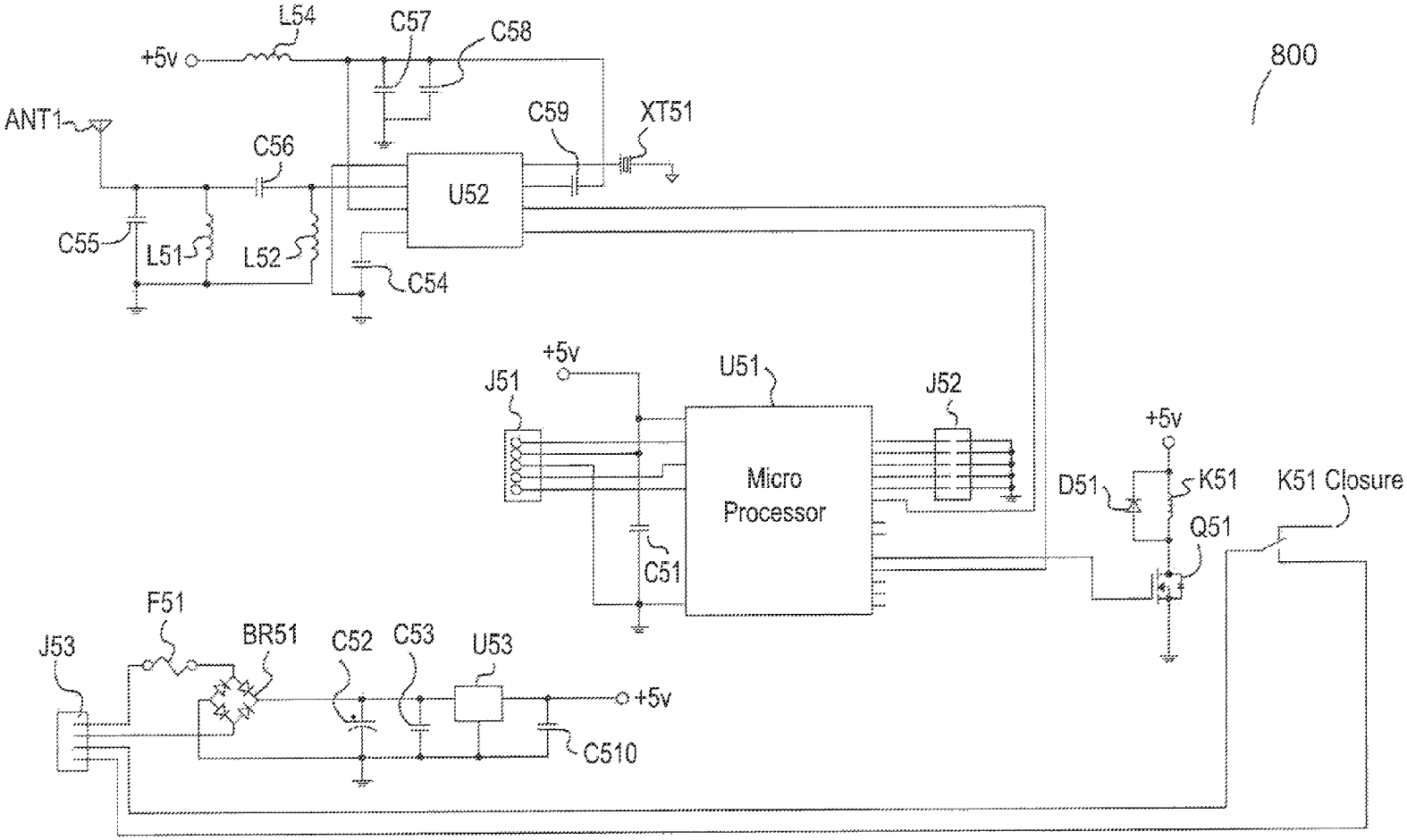
FIG. 5 illustrates a receiver circuit of the shut-off circuit of the fire extinguishing system according to the disclosed embodiments.

FIG. 5 depicts receiver circuit 800 of the shut-off configuration according to the disclosed embodiments. Receiver circuit 800 is designed to work with transmitter circuit 600 to form a wireless link for performing a remote shut-off of range power. Receiver 800 is designed to receive a serial data stream of on-off-keyed carrier at 433.92 MHz.

Circuit 800 is powered up full-time as continually looking for a unique code to be received from transmitter circuit 600, disclosed above. Circuit 800 is powered by 12-volts AC received through its connector J53. This voltage is rectified by bridge BR51, then filtered and regulated to 5-volts DC by regulator U53. Radio receiver U52 continuously demodulates any RF signals and sends this demodulated data to receiver microcontroller U51. If the correct code is received, receiver microcontroller U1 will activate receiver relay K51 by driving the gate of transistor Q51 with a logic "high." Relay K51 closure appears at pins of connector J53. When no valid code has been received for 1 second, receiver microcontroller U51 will deactivate relay K51.

The code to be received may be altered by applying different combinations of jumpers on jumper field J52. The jumper configuration needs to match the jumpers on transmitter 600 in order for these components to work together. As with transmitter 600, there are 32 possible co-combinations for use within different jumper configurations at jumper field J52.

Thus, according to the enclosed embodiments, a fire may be detected on heating device 10. Alarm circuit 30 may engage fire prevention measures as well as power shut-off during the detection of an emergency condition. By using an RF signal, different codes may be incorporated to allow a plurality of heating devices to be located near each other. Each transmitter-receiver pair, may have its own unique code programmed using circuits 600 and 800. Additional gas or power may be prevented from being supplied to the burners of heating device 10.

Table 3 below includes a list of the components configured to enable the circuit schematic shown in FIG. 5, some of which are disclosed above. The components listed in Table 3 are shown for illustrative purposes only, and the disclosed embodiments are not limited to the values or number of components disclosed therein.

TABLE 3

| | |
|---|---|
| ANT1 | Antenna, preferably stranded wire |
| D51 | Diode |
| C56 | 4.7 pf capacitor |
| C510 | 1 uf capacitor |
| C59 | 2.2 uf/63 volts capacitor |
| J52 | 2x5 header |
| J51 | 1x5 header |
| C51, C53, C54, C57 | .1 uf capacitors |
| F51 | Fuse |
| C55 | 5.6 pf/50 volts capacitor |
| XT51 | 13.4916 MHertz crystal |
| L51 | 24 NH inductor |
| L52 | 30 NH inductor |
| U53 | Voltage regulator IC |
| C58 | 100 pf/50 volt capacitor |
| C52 | 220 uf/35 volt capacitor |
| L53, L54 | Ferrite bead |
| K51 | 5 volt DC relay |
| J53 | 4-pin connector |
| BR51 | Bridge rectifier IC |
| U52 | RF receiver IC |
| U51 | Microprocessor IC |
| Q51 | N-channel FET transistor |

Thus, alarm circuit 30 may be configured as shown in FIGS. 3A-C, 4 and 5. The example configuration may be incorporated into the disclosed fire extinguishing system to manage, detect, activate and shut down operations. Sensors detect information and provide this information to alarm circuit 30, which determines a course of action based on the processes disclosed below. Alternative configurations may be utilized to achieve the functionality disclosed herein.

The disclosed fire extinguishing system enables several modes of operation. These modes include reset/power-on reset, diagnostic tests, normal run mode or fire detect mode, shut-off sequence, an alarm sequence. Several sequences of events may occur during each mode, as disclosed below. These modes may be controlled via alarm circuit 30.

Figure 6:
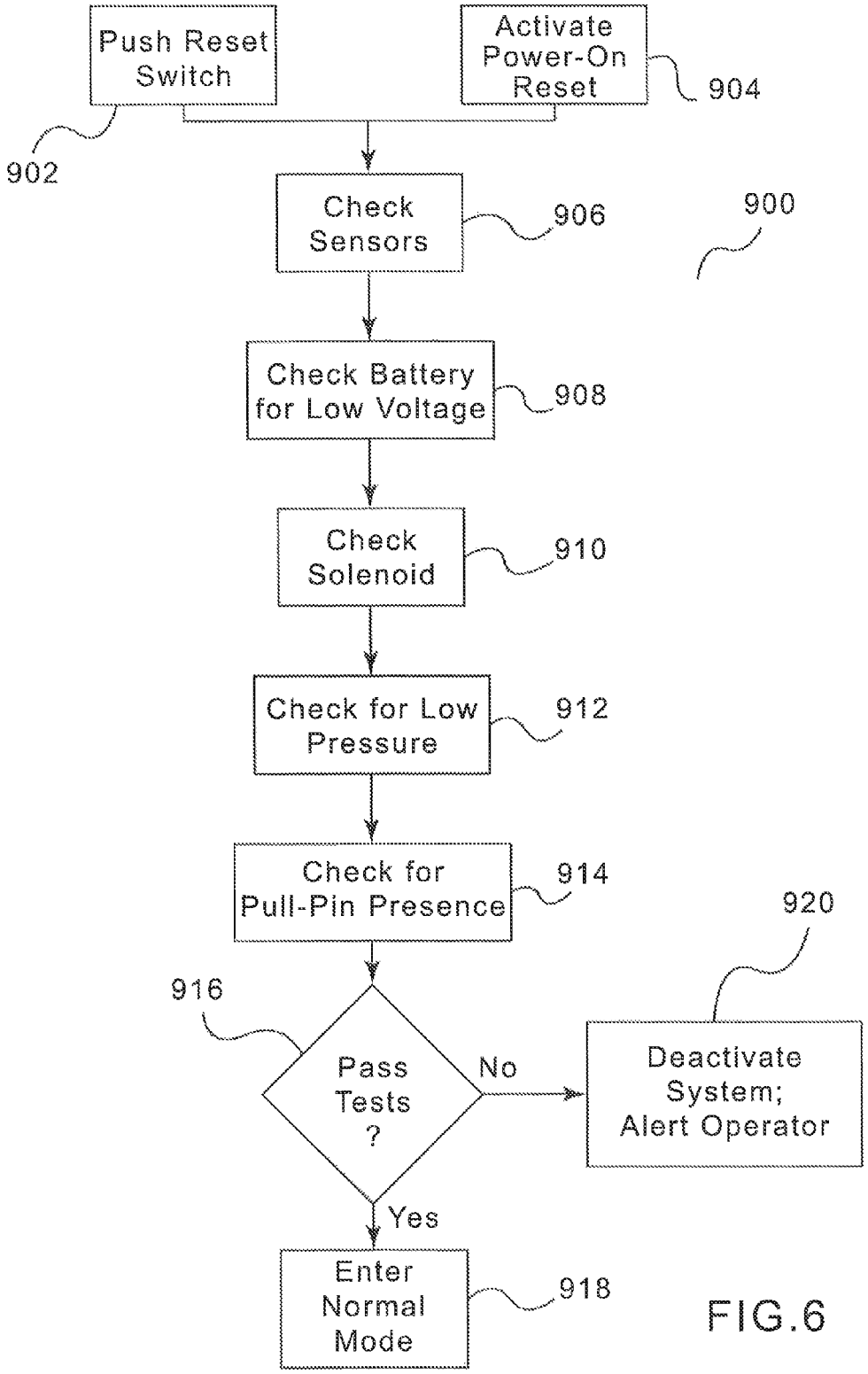
FIG. 6 illustrates a flowchart for operating in the reset/power-on reset mode according to the disclosed embodiments.

FIG. 6 depicts a flow chart 900 for operating in the reset/power-on reset mode according to the disclosed embodiments. Step 902 executes by pushing the reset switch, shown in FIGS. 3 and 4. Alternatively, step 904 executes by activating a power-on reset when the fire extinguishing system is turned on. Immediately upon reset, the disclosed system may determine 6 conditions before entering the main function of the unit.

Thus, step 906 executes by checking sensors 1 and 2. Each sensor check may be performed as a separate step. The test of the two sensors 1 and 2 will determine if the voltage sensed by the sensors complies with specified conditions. An open circuit, a short circuit, reversed wiring, or a defective sensor should result in failing of this test. Step 908 executes by checking the battery, preferably the 9-volt battery, for low voltage.

Step 910 executes by checking the solenoid 67. This solenoid test determines if there is continuity between the two solenoid connections. If not, then this mode may detect an open circuit. Further testing may not be done because it causes an unwanted dump of suppressant.

Step 912 executes by checking for a low pressure condition within the fire suppressant containers 32. If a low pressure condition is detected, then the suppressant containers may not activate during a fire emergency. Thus, the fire suppressant should be replaced. Step 914 executes by checking for the pull-pin presence within alarm circuit 30.

Step 916 executes by determining whether the fire extinguishing system passed all the above tests. If yes, then step 918 executes by entering normal mode by the fire extinguishing system. If step 916 is no, then step 920 executes by deactivating the system and alerting the operator of the faulty condition. If the reset mode passes all the above tests, then the green LED of FIG. 3B (v) will light up for approximately 2 seconds.

Figure 7:
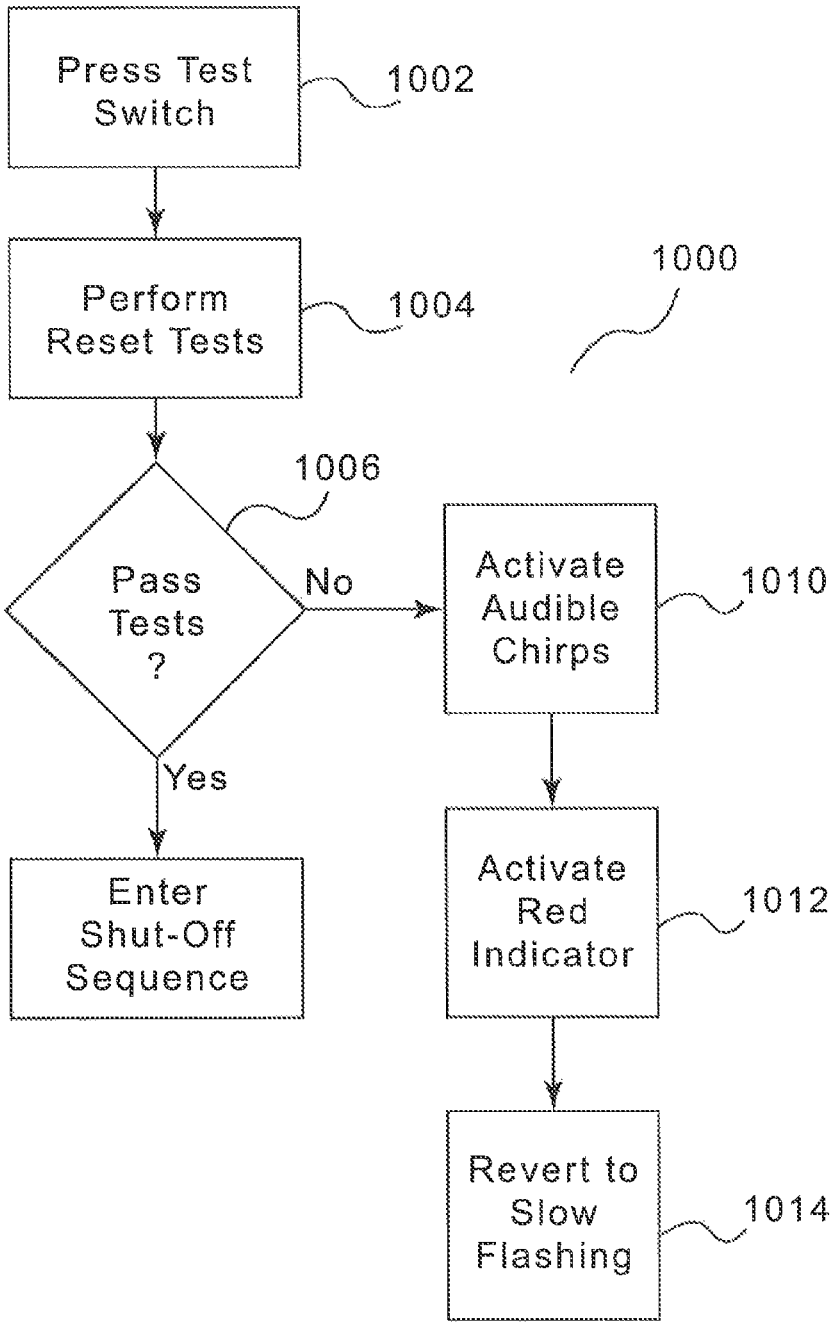
FIG. 7 illustrates a flowchart for performing the diagnostic test mode according to the disclosed embodiments.

FIG. 7 depicts a flow chart 1000 for performing the diagnostic test mode according to the disclosed embodiments. Step 1002 executes by pressing a test switch that will enter the main unit, such as alarm circuit 30 into a diagnostic test mode. The test switch should be pressed and released. Step 1004 executes by performing the same test as done in the reset mode, disclosed above.

Step 1006 executes by determining whether the fire extinguishing system passed the test. If yes, then 1008 executes by entering a shut-off sequence, disclosed in greater detail below. This shut-off sequence provides a way to verify that the entire fire extinguishing system is working properly and that the shut-off function may occur in normal operation.

If step 1006 is no, then step 1010 executes by activating audible chirps using sounder SR31 to alert personnel that a test has failed. The number of chirps indicates a diagnostic failure code. For example, 1 chirp may indicate that sensor 1 or a remote pull has failed. Two chirps may indicate that sensor 2 has failed. Three chirps may indicate that the battery voltage is low. Four chirps may indicate that solenoid 67 does not have continuity between the two solenoid connections. Five chirps may indicate that a low pressure condition exists. Six chirps may indicate that the pull-pin is not present. Step 1012 executes by activating a red indicator, preferably the red LED, to visually alert personnel of a failure condition. Step 1014 executes by reverting to a slow flashing red indication. Tests may be performed in the same order as disclosed above with the reset mode. Neither the reset mode nor the diagnostic test mode will result in solenoid activation with a resultant suppressant dump.

Figure 8:
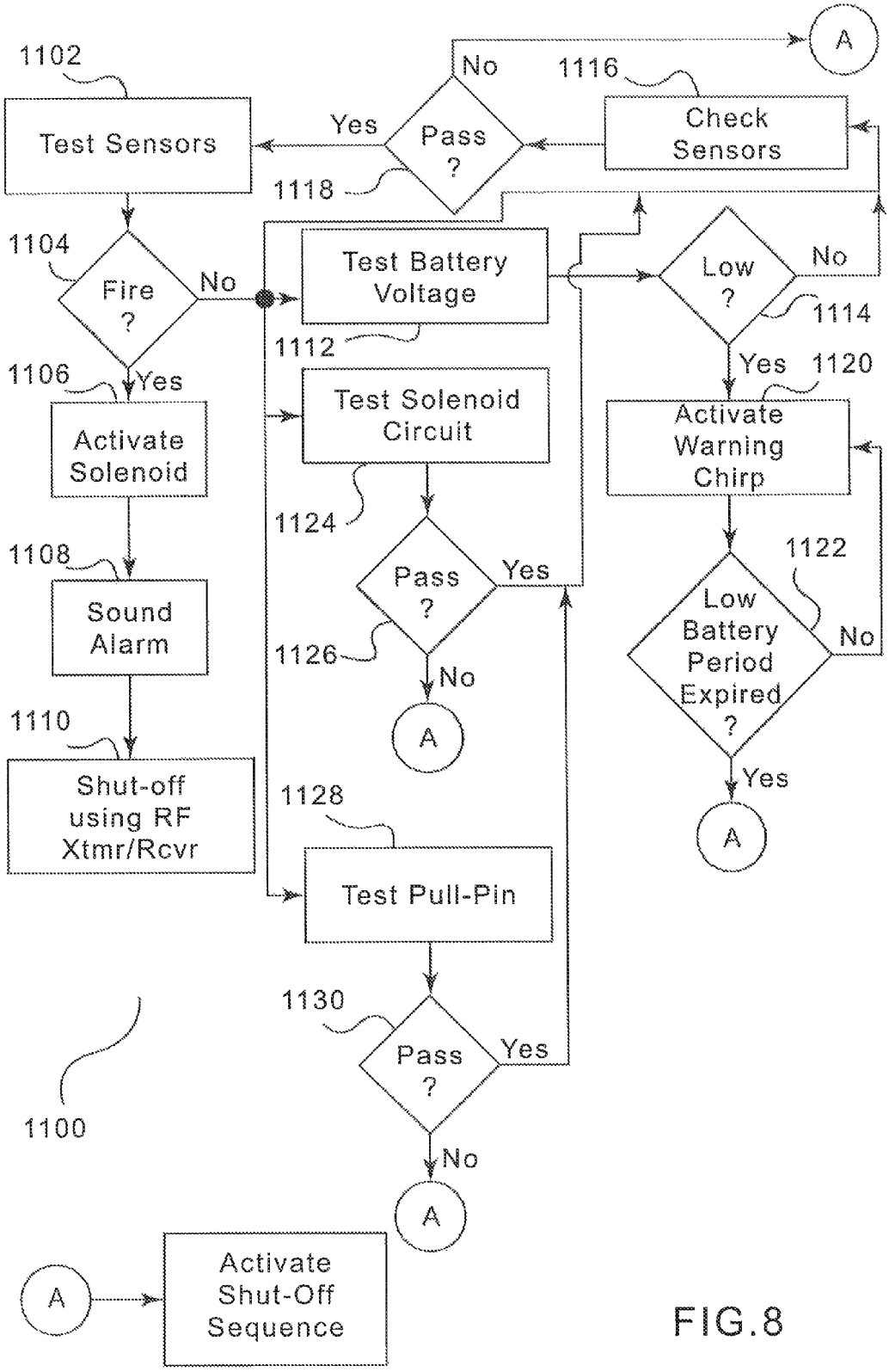
FIG. 8 illustrates a flowchart for operating during the normal run mode for the fire extinguishing system according to the disclosed embodiments.

FIG. 8 depicts a flow chart 1100 for operating during the normal run mode for the fire extinguishing system according to the disclosed embodiments. This mode also may be known as the fire detect mode. During a normal fire-detect mode, the fire extinguishing system detects a fire condition as well as monitors the various components of the system. Thus, the disclosed embodiments may provide an alarm signal as well as a trouble or alert signal to let operators know that the fire extinguishing system needs to be serviced. If a test or condition fails, then the fire extinguishing system may perform a shut-off sequence.

Step 1102 executes by testing the two sensors S1 and S2 approximately every 2 seconds to detect a high temperature condition, indicative of a fire or a fire-like condition. Step 1104 executes by determining whether a fire condition is detected. If yes, then step 1106 executes by activating the solenoid circuit, or solenoid 67, to dump the fire suppressant from the fire extinguishing system. Further, latching relays K32 and K33 will activate. Step 1108 executes by sounding the alarm. Step 1110 executes by shutting-off heating device 10 using the transmitter-receiver RF circuit 600 and 800 disclosed above.

If step 1104 is no, then steps 1112, 1124 and 1128 are executed to provide a "normal run mode" that detects faulty conditions within the fire extinguishing system. Steps 1112,

1124 and 1128 may be executed at the same time or frequency, or may be executed at different times. In general, detection of a faulty condition by these processes will result in steps being taken to alert an operator and prevent any harm.

Step 1112 executes by testing the battery voltage of the 9V battery within the fire extinguishing system. Preferably, once every 32 passes of the sensor testing for the fire condition, the battery voltage is tested. The battery may be tested to determine if the voltage is less than 7.5 volts DC but greater than 7.0 volts DC. Other ranges may be used according to the disclosed embodiments. Step 1114 executes by determining whether the battery voltage is low.

If no, then step 1116 executes by checking sensors S1 and S2 to make sure that the sensor circuits have not gone "open" or inadvertently disconnected. Step 1118 executes by determining whether the sensors pass the test in step 1116. If yes, then flowchart 1100 returns to step 1102. If step 1118 is no, then flowchart 1100 executes a shut-off sequence, represented by A in FIG. 11. The shut-off sequence removes power to heating device 10. It should be noted that steps 1116 and after may be executed independent of the battery test steps, and performed when the sensors are used to detect a fire condition, for example.

If step 1114 is yes, then step 1120 executes by activating a warning chirp to using sounder SR31 alert an operator that the battery needs to be changed. Heating device 10 may continue to function normally. The warning chirp may occur about every 65 seconds. If a reset mode is initiated in this situation, then heating device 10 will not resume normal operation because it cannot pass the reset test or the diagnostic test.

Step 1122 executes by determining whether a period for the low battery alert has expired. After the low battery chirps have been issued for a period of time (preferably 4.5 hours), alarm circuit 30 may issue a shut-off command to prevent use of heating device 10 as the fire suppression system is not fully operational. Thus, if yes, then flowchart 1100 moves to step A. If no, and the period of time has not passed, then flowchart 1100 returns to step 1120 to continue activating warning chirps.

If at any point when the battery is tested and the voltage is below 7.0 volts DC, and no AC/DC adapter is supplying power, then alarm circuit 30 will immediately skip to step A to initiate a shut-off sequence. This action prevents the use of heating device 10 because the fire suppression system is not fully operational. Thus, steps 1112 and 1114 may be modified to include this third option that goes directly to step A under specified conditions.

Step 1124 executes by testing the solenoid circuit of the fire extinguishing system. The solenoid circuit for solenoid 67 is tested for an open-circuit condition. This test may occur with the battery low voltage test. Step 1126 executes by determining whether the test is passed. If yes, then flowchart 1100 goes to step 1116. If no, then step A is executed to activate the shut-off sequence.

Step 1128 executes by testing the pull-pin connection is still in place. This feature is disclosed in greater detail below. Step 1130 executes by determining whether this test is passed. If yes, then flowchart 1100 goes to step 1116. If no, then step A is executed to activate the shut-off sequence.

Figure 9:
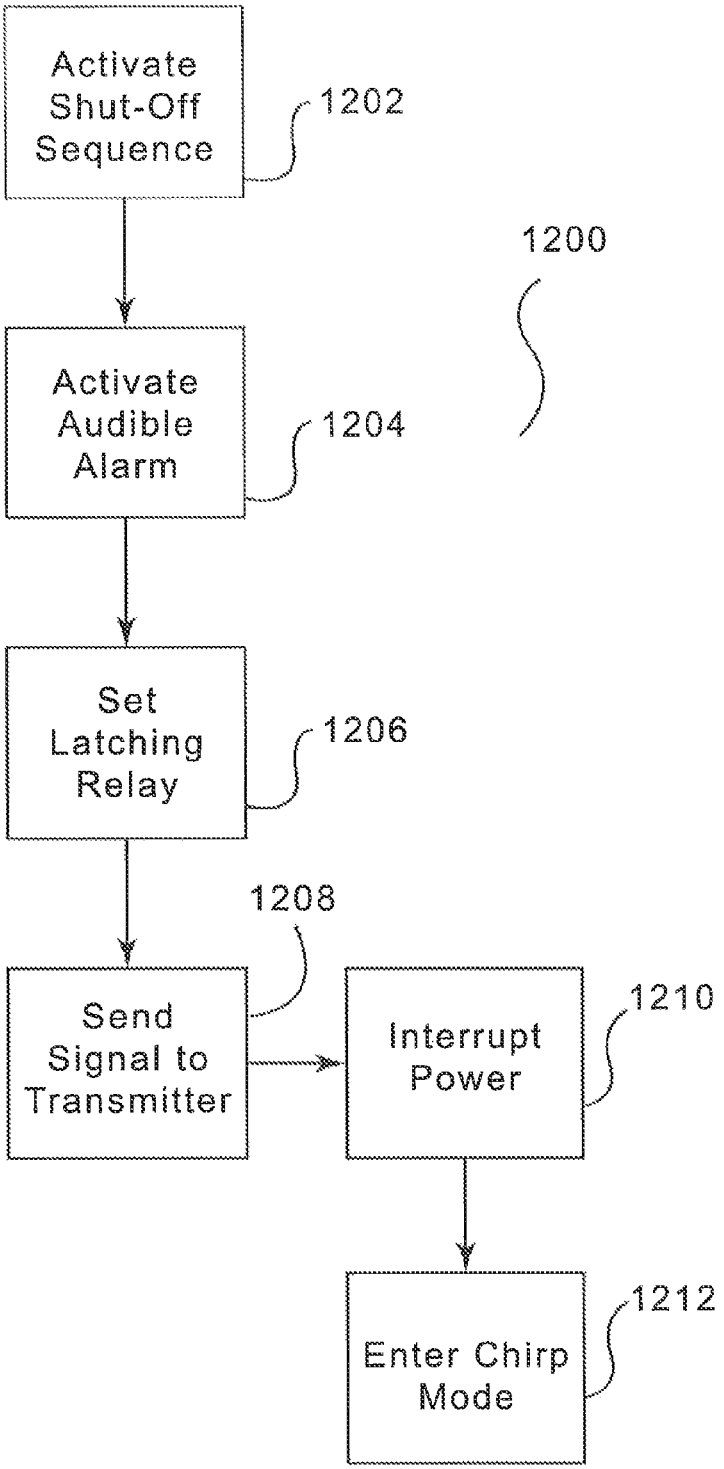
FIG. 9 illustrates a flowchart for a shut-off sequence mode according to the disclosed embodiments.

FIG. 9 depicts a flowchart 1200 for a shut-off sequence mode according to the disclosed embodiments. Step 1202 executes by activating the shut-off sequence in response to one of the conditions disclosed above occurring during the diagnostic test mode or normal run mode. Preferably, six conditions activate the shut-off sequence: i) low battery condition has persisted for about 4.5 hours, ii) a test sequence was executed successfully, iii) the pull-pin was removed from its receptacle during normal operation, iv) an open circuit was detected on one of the sensors during normal run mode, v) an open circuit was detected on the solenoid circuit during normal run mode, and vi) the low-pressure switch from the tank is closed.

Step 1204 executes by activating the audible alarm for about 10 seconds to alert an operator that heating device 10 is being shut down. Step 1206 executes by setting latching relay K3. Step 1208 executes by sending a signal to activate the transmitter 600 of the RF circuit. The transmitter 600, disclosed in greater detail above, sends an RF signal to the receiver 800 to shut off the power. Step 1210 executes by interrupting the main power, either gas or electric, to heating device 10. Step 1212 executes by entering chirp mode. Following the ten seconds of audible alert, alarm circuit 30 will issue a chirp about every minute to alert the operator that the shut-off has already taken place.

If latching relay K3 is used for hard-wired shut-off control, and the fire extinguishing system is battery-powered only, then removing the battery will cause a shut-off sequence to occur. The audible alert may not sound. Once the battery is replaced, then the shut-off condition must be reset.

According to the disclosed embodiments, an alarm sequence may occur if a low voltage is detected at one or both of the sensors. This condition is an indication of very high temperatures or of a short across the sensor circuit. This sequence may be entered from the normal run mode. A short circuit across the sensors at power-up or during a test sequence will result in a failure condition that prevents heating device 10 from entering normal run mode.

The alarm sequence may cause a suppressant dump, set latching relays K2 and K3, and send the RF link activation signal. All of these processes are disclosed in greater detail above. The main power source to heating device 10 is interrupted. This cycle will continue until the unit is reset or the battery is depleted in the case of battery-only operation. Latching relay K2 is provided as a building alarm. It is set in the case of a detected fire. The building alarm should not activate when only a shut-off sequence occurs.

Figure 10:
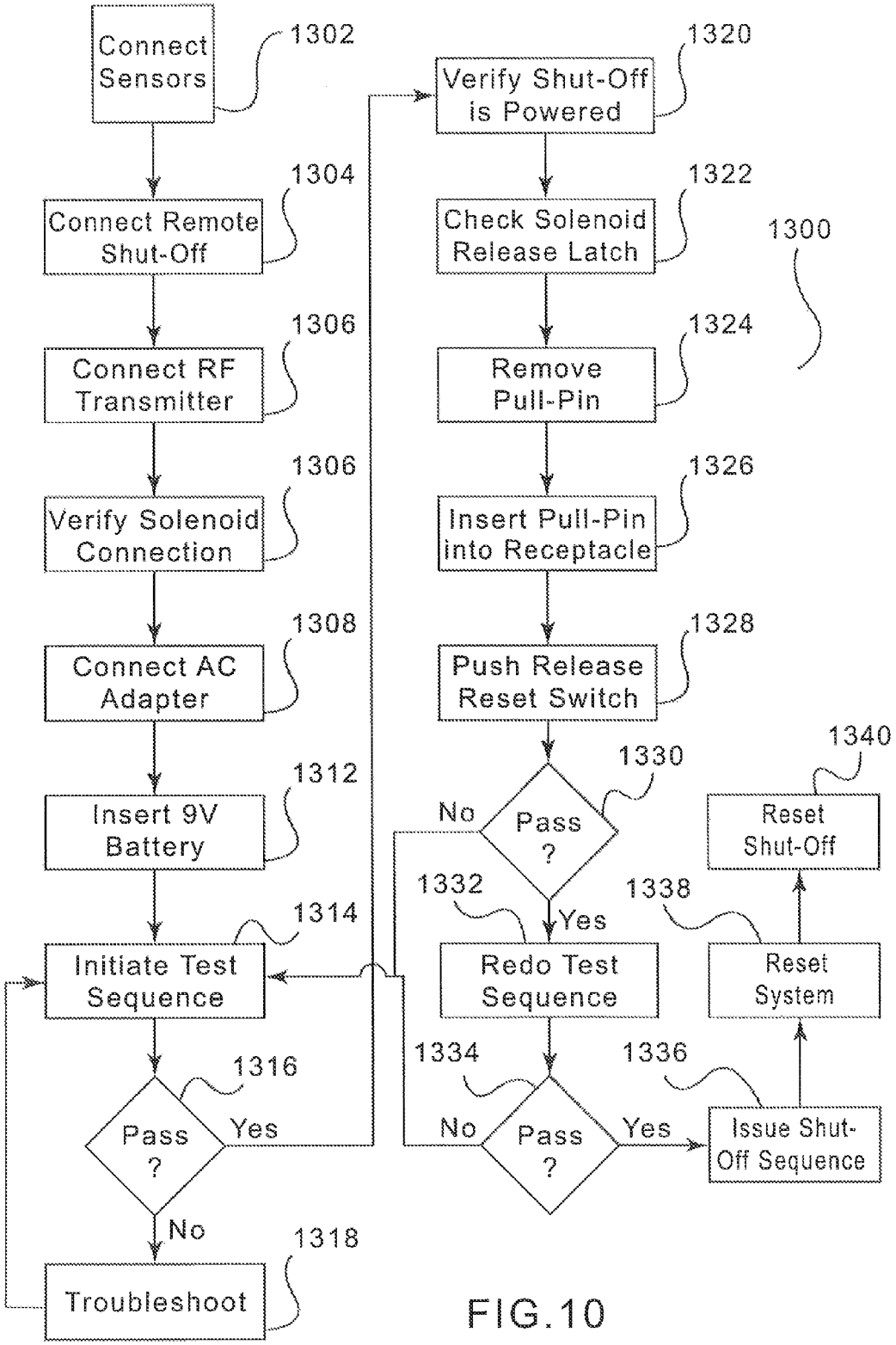
FIG. 10 illustrates a flowchart for performing an installation/operational checkout according to the disclosed embodiments.

FIG. 10 depicts a flowchart 1300 for performing an installation/operational checkout according to the disclosed embodiments after completing the physical installation of the main unit (alarm circuit 30), sensors, shut-off circuit and any optional equipment. Step 1302 executes by connecting sensors 1 and 2 to alarm circuit 30. Step 1304 executes by connecting the remote shut-off to alarm circuit 30 if a hard-wired option is used to activate the shut-off sequence. Step 1306 executes by connecting the RF transmitter 600 to alarm circuit 30 if the RF remote shut-off is used.

Step 1308 executes by verifying the solenoid connection of solenoid 67 is present from the tank to the main unit. Step 1310 executes by connecting the AC adapter to the main unit, if desired. Step 1312 executes by inserting the 9V battery into the battery holder.

Step 1314 executes by initiating a test sequence by pushing a releasing the test switch. The test sequence should "fail" and issue 6 chirps, thereby indicating that the pull-pin has not been removed from the tank. If the result is less than 6 chirps, then some test before the pull-pin test has failed, as disclosed with the diagnostic test mode above. Thus, step 1316 executes by determining whether the test sequence "passes" by issuing 6 chirps. If no, then step 1318 executes by troubleshooting to find the faulty condition.

If step 1316 is yes, then step 1320 executes by verifying that the shut-off circuit is powered and reset. In other words, heating device 10 is on. Step 1322 executes by checking that the solenoid release latch is engaged. Step 1324 executes by removing the pull-pin. Step 1326 executes by inserting the pull-pin into its receptacle on the main unit board. When the pull-pin is removed, it may be placed in a cup attached to the main unit board.

Step 1328 executes by pushing and releasing the reset switch. A momentary green, preferably LED, light will indicate that all initial tests have passed. Step 1330 executes by determining that the initial tests have passed. If no, then flowchart 1300 returns to step 1314 to initiate the test sequence for troubleshooting the faulty condition. A blinking red light should result as well. If yes, then step 1332 is executed by redoing the test sequence, but this time taking into account the passage of the pull-pin test.

Step 1334 executes by determining if the final test sequence passes. If step 1334 is no, then flowchart 1300 returns to step 1314. If step 1334 is yes, then step 1336 executes by issuing a shut-off sequence. This step allows complete verification all the way to shut-off without the suppressant dump. Step 1338 executes by resetting the fire extinguishing system. Step 1340 executes by resetting the shut-off.

The above disclosed functions may be implemented by instructions executed by the microprocessors and logic shown in the Figures. The instructions may be stored in a memory that is accessible by the microprocessors. Further, input data collected by the disclosed system is used to prompt the microprocessors into action using hardware, software, or firmware embodiments of the present invention. These instructions may come loaded onto the various components, or may be downloaded onto the components using the connectors and components described herein. Further, the disclosed alarm circuit may be connected to a wireless network such that an alarm condition results in the RF signal going to the receiver for shut off, but also to alert a user over the wireless network.

According to the disclosed embodiments, the alarm circuit detects a fire, overheat, or the like, on a stove or other cooking device. In response to the emergency, the alarm circuit orders a suppressant dump to occur over the burners or other heating elements to prevent further damage or the spreading of the emergency. An acoustic alarm may be activated to alert personnel that an emergency condition is taking place.

A shut-off circuit also is attached to the alarm circuit and used to shut off power or gas during an emergency. Thus, along with the acoustic alarm, an RF transmitter emits an RF signal that is received by a receiver coupled to the shut off mechanism. The RF signal differs from the acoustic signal in that it may be set to a specified frequency particular to the stove so that it does not interfere with other RF signals. For example, a commercial kitchen may include a plurality of stoves having a corresponding number of alarm circuits. One does not want all of the alarm circuits using the same frequency for the RF signals. The disclosed embodiments allow for different frequencies to be set as desired to prevent interference.

Further, using the disclosed configuration, the fire extinguishing system using the alarm circuit may diagnose faulty conditions and perform status checks to ensure that components within the system work properly. The disclosed system checks for battery power, pressure within the suppressant containers, and other conditions. If a condition is detected, then audible alarms may signal to personnel that an action needs to be taken. After a period of time, the alarm circuit may shut down the device to prevent harm to personnel or damage to equipment.

From the foregoing description, one skilled in the art can easily ascertain the essential characteristics of the invention without departing from the spirit and scope thereof. One may make various changes and modifications of the disclosed embodiments to adapt it to equivalent usages and conditions, as long as the equivalents come within the scope of the claims listed below.

The invention claimed is:

1. A fire extinguishing system for an appliance to detect an emergency condition, the fire extinguishing system comprising:

at least one sensor for detecting a condition regarding the appliance;

an alarm circuit coupled to the at least one sensor;

a radio frequency (RF) transmitter circuit coupled to the alarm circuit through a common-mode choke, the RF transmitter circuit configured to transmit an RF signal at a specified frequency when powered up by a transistor coupled to the common-mode choke, wherein a code transmitted at the frequency is programmed into a microprocessor within the RF transmitter circuit; and a shut-off assembly configured to shut-off the appliance, wherein the shut-off assembly includes an RF receiver circuit configured to receive the RF signal having the code at the specified frequency to initiate a shut-off sequence.

2. The fire extinguishing system of claim 1, wherein the shut-off assembly is configured to shut-off power to the appliance.

3. The fire extinguishing system of claim 1, wherein the shut-off assembly is configured to shut-off gas to the appliance.

4. The fire extinguishing system of claim 1, further comprising a battery for the alarm circuit, wherein the condition corresponds to a low power level in the battery.

5. The fire extinguishing system of claim 1, further comprising a plurality of light emitting diodes within the alarm circuit.

6. The fire extinguishing system of claim 1, further comprising a fire extinguisher coupled to the alarm circuit.

7. The fire extinguishing system of claim 6, further comprising a low pressure indicator for the fire extinguisher coupled to the alarm circuit.

8. The fire extinguishing system of claim 1, further comprising a pull-pin configuration, wherein the pull-pin is inserted to the alarm circuit.

9. A safety device for an appliance comprising:

an RF receiver to receive an RF signal transmitted in response to a command from an alarm circuit, wherein the RF receiver includes a radio receiver to demodulate the RF signal into demodulated data, and a microcontroller to compare the demodulated data to a code, wherein the code is set at the RF receiver using a jumper field; and a shut-off assembly coupled between the appliance and a power source, wherein a connection is closed between the appliance and the power source in response to the code corresponding to the RF signal.

10. The safety device of claim 9, wherein the shut-off assembly includes an electrical switch.

11. The safety device of claim 10, wherein the electrical switch shuts off power to the appliance.

12. The safety device of claim 9, wherein the shut-off assembly includes a valve.

13. The safety device of claim 11, wherein the valve shuts off gas supplied to the appliance from the source.

14. A method for shutting off an appliance during an emergency condition, the method comprising:

detecting a condition on the appliance using an alarm circuit;

sending an RF signal from a transmitter circuit connected to the alarm circuit at a specified frequency in response to the detected condition and powered up by a transistor coupled to a common-mode choke, wherein a code for the frequency is programmed into a microprocessor within the RF transmitter circuit;

receiving the RF signal at a receiver circuit; and activating a shut-off sequence in response to the RF signal having the code at the specified frequency to initiate the shut-off sequence to shut off power or gas to the appliance.

15. The method of claim 14, further comprising activating an audible alarm in response to the condition detected by the alarm circuit.

* * * * *